US005588813A

United States Patent [19]

Berke-Jorgensen

[11] Patent Number: 5,588,813

[45] Date of Patent: Dec. 31, 1996

[54] FLUID MOTOR DRIVEN PUMP ARRANGEMENT HAVING MOTIVE FLUID EXHAUST INTO THE PUMP CHAMBER

[76] Inventor: Jorgen Berke-Jorgensen, Gramvej 76, Fruering, DK-8660, Skanderborg, Denmark

[21] Appl. No.: 331,660

[22] PCT Filed: May 5, 1993

[86] PCT No.: PCT/DK93/00151

§ 371 Date: Jan. 27, 1995

§ 102(e) Date: Jan. 27, 1995

[87] PCT Pub. No.: WO93/22556

PCT Pub. Date: Nov. 11, 1993

[30] Foreign Application Priority Data

May 7, 1992 [DK] Denmark ..... 0600/92

[51] Int. Cl.[6] ..... F04B 9/115

[52] U.S. Cl. ..... 417/391; 91/341 A; 91/346

[58] Field of Search ..... 417/391, 393, 417/401, 503, 535, 506, 568; 91/341 A, 341 R, 344, 346

[56] References Cited

U.S. PATENT DOCUMENTS

| | | | |
|---|---|---|---|
| 274,879 | 3/1883 | Barton et al. | 91/346 |
| 1,164,926 | 12/1915 | Clark | 417/393 |
| 2,798,440 | 7/1957 | Hall | 417/393 |
| 3,331,330 | 7/1967 | Harklau et al. | 91/341 R |
| 3,589,839 | 6/1971 | Johnson | 417/391 |
| 4,096,059 | 6/1978 | Pinkerton | 417/391 |

FOREIGN PATENT DOCUMENTS

| | | |
|---|---|---|
| 0081300 | 6/1983 | European Pat. Off. . |
| 0223568 | 5/1987 | European Pat. Off. . |
| 2312647 | 9/1974 | Germany . |
| 91036558 | 6/1993 | Sweden . |
| 2147056 | 5/1985 | United Kingdom . |
| 8809006 | 11/1988 | WIPO . |

*Primary Examiner*—Timothy Thorpe
*Assistant Examiner*—Roland G. McAndrews, Jr.
*Attorney, Agent, or Firm*—Leonard Bloom

[57] ABSTRACT

The dosing arrangement comprises two first pumps for a liquid medium B whose pistons are mutually connected by a piston rod, and two other pumps and for a liquid medium A which are positioned outside in continuation of and coupled to the pumps for liquid B. The two pumps for liquid B are firmly fixed to a central body which is hollow and filled up with liquid B, and in which are mounted two mutually connected suction valves which are activated by the pistons by means of a push rod and switched over momentarily from one extreme position to another by a spring mechanism and two exhaust valves whose movements are derived from the valves. Furthermore, the central body incorporates an opening/closing arrangement, which can admit a variable volume of liquid B through a valve into the cylinder for liquid A, which is under a suction pressure, whereby the proportion of mix can be regulated.

9 Claims, 9 Drawing Sheets

FLUID MOTOR DRIVEN PUMP ARRANGEMENT HAVING MOTIVE FLUID EXHAUST INTO THE PUMP CHAMBER

BACKGROUND OF THE INVENTION

The present invention relates to a fluid motor driven pump arrangement having motive fluid exhaust in the pump chamber.

Danish Patent No. 155656 discloses a mixing plant for mixing one component, for example lubricating oil, with another component, for example gasoline, which drives a piston type liquid motor which in turn drives a crank shaft on which is mounted a rotating valve. This controls delivery and discharge of the drive medium to two pistons in the liquid motor, and an impulse generator coupled to an electronic counting device.

To one of the pistons or to both pistons, there is coupled a piston in a dosing pump by means of a compressible connection rod. The stroke of the piston in the dosing pump, and consequently the performance of the pump, can be varied by means of an adjustable stop or a stop screw mounted in the top of the cylinder in the dosing pump.

The said known mixing plant does not seem to comprise means to prevent the liquid motor from stopping in an extreme position. This might be overcome with a flywheel, but there will still remain the problem of starting the motor from such extreme position. Furthermore, the shown rotating valve must have the effect that, during the change-over operation, a slow-down in the speed of the closing for flow of liquid to and from the cylinders will occur before there is a free flow again. This produces an uneven delivery and discharge of liquid, possibly with harmful liquid-hammer blows. Adjustment of the dosing operation by means of an adjustable stop screw is not well suited if the dosing pump is to operate with high as well as low pressures. Furthermore, the known system will give a periodic delivery of the liquid medium which is to be dosed.

Furthermore, mixing plants are known in which a liquid medium A is dosed into another liquid B which flows through a pipe, and in which the volume of flow of liquid B is metered by a flowmeter. This could, for instance, consist of a turbine wheel giving electric impulses in relation to the volume of flow through the pipe. Other metering methods consist of a magnetic field being laid over the flowing liquid or sending ultrasonic signals through the liquid.

But it does not always happen that the electrical conductivity or the sound-dampening character of the liquid medium permits the use of electro-magnetic flowmeters or ultrasonic flowmeters.

The liquid flow is converted to an electrical signal which is an input signal to an electronic circuit whose output signal is used to control an electrically driven dosing pump, which could be an electric motor or a solenoid coil, which moves a piston or a diaphragm in the pump.

The dosing accuracy is determined by the accuracy of the flowmeter. Many types of flowmeters do not, neither in theory nor in practice, live up to a linear relation between volume flow and signal emitted. If an accurate metering is needed, it will be necessary to use flowmeters which are relatively expensive.

These systems consist of several components, which have to be connected electrically or hydraulically to each other, and it will be necessary to have one or more electrical voltage supplies. It is a great drawback to have electrical components in a plant with flowing aggressive chemicals or strong electrolytes, which easily penetrate electrical components and cause corrosion and short circuiting in the live components.

BRIEF SUMMARY OF THE INVENTION

It is the purpose of the present invention to describe a dosing arrangement which does not exhibit the drawbacks of the known dosing arrangements.

According to the invention, a dosing arrangement is disclosed in which the cylinder volume of the piston motor is filled with a liquid medium B. One charge gives a complete piston stroke and then the cylinder is evacuated and the process is repeated. This gives a close relation between the volume of liquid B which passes the motor and the number of piston strokes. The motor piston is coupled to the dosing pump piston, which is thereby given the same length of stroke. If the motor piston has the area $A_B$ and the dosing pump the area $A_A$ this gives a dosing $D_M$ which will be constant in the equation $D_M=A_A/A_A+A_B$.

The invention provides a technical solution to the problem of finding a simple way to vary the dosing D between D=0 and $D=D_m$, and how to adjust the dosing with infinite accuracy even in the case of very small doses.

The valves controlling the liquid flow to and from the cylinders are activated by the direct action of the piston movement, and the changeover of the valves is instantaneous so that there is a full throughput in the inlet valve as soon as the motor piston is in its bottom position, and through an outlet valve when the motor piston is in its top position. This eliminates dead points, just as a maximum performance of the dosing arrangement is achieved.

A preferred embodiment of a spring mechanism for the control of the valves in the liquid motor is disclosed.

A method is disclosed of how to bring the sliding block past the center position of the push rod, so that the inlet valves are closed instantaneously by spring force.

Special means are disclosed whereby the movement of the outlet valves is coupled to the movement of the inlet valves.

An embodiment is disclosed of an opening/closing arrangement which depends on the movement of the piston rod to deliver a variable volume of liquid B from the central body to the cylinder which is under suction pressure.

A special embodiment is disclosed of the recess in a plate which forms part of the opening/closing mechanism.

Another embodiment is disclosed of an opening/closing arrangement.

A means is disclosed for holding the piston rod in an unchanged rotary position.

A special embodiment is disclosed of the recesses in a bushing, which is part of another embodiment of the opening/closing arrangement.

BRIEF DESCRIPTION OF THE DRAWINGS

The present invention is described in detail in the following with reference to the drawing in which.

DESCRIPTION

Figure 1:
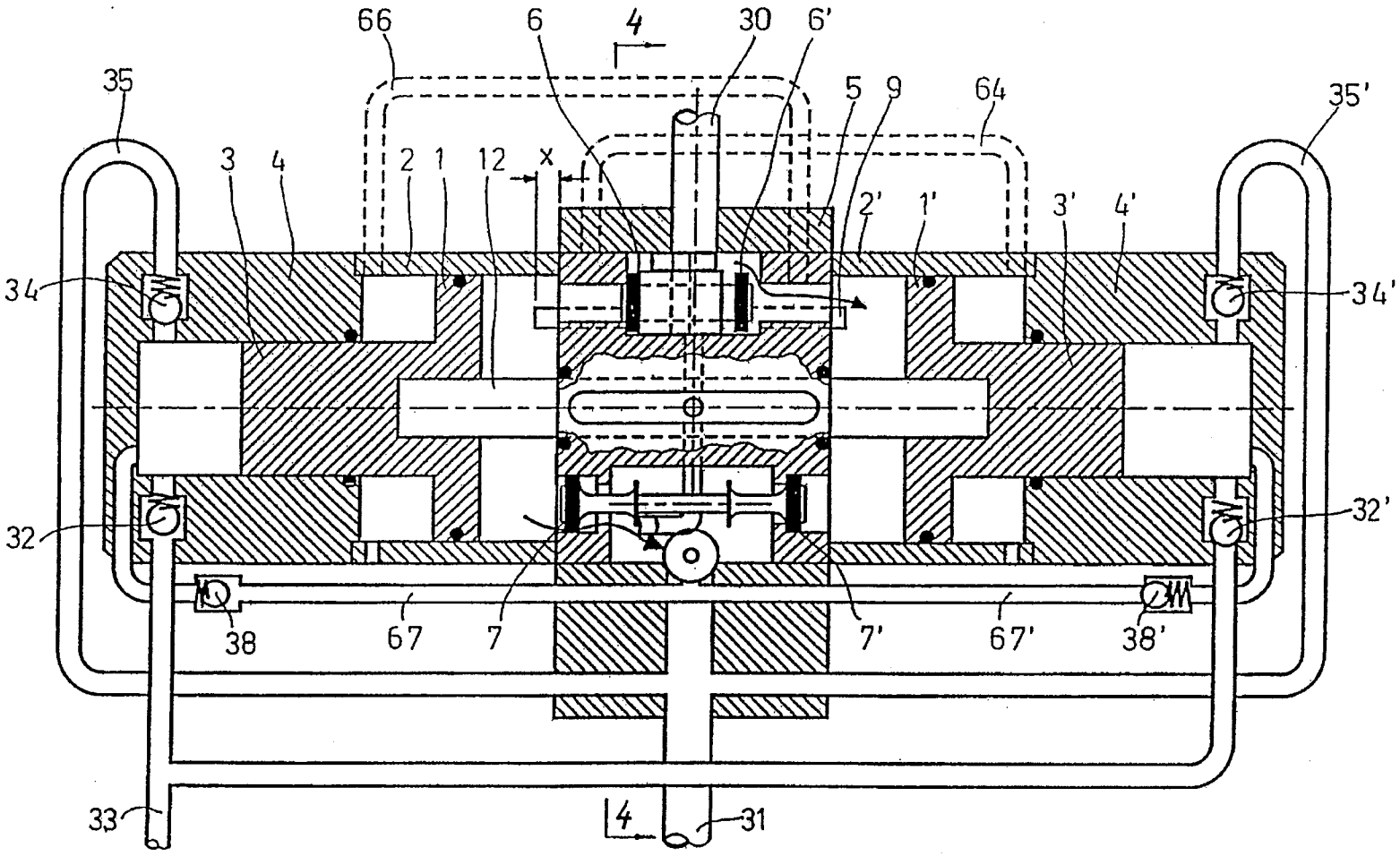
FIG. 1 shows a vertical diametrical section through an embodiment of a dosing arrangement according to the invention.
Figure 2:
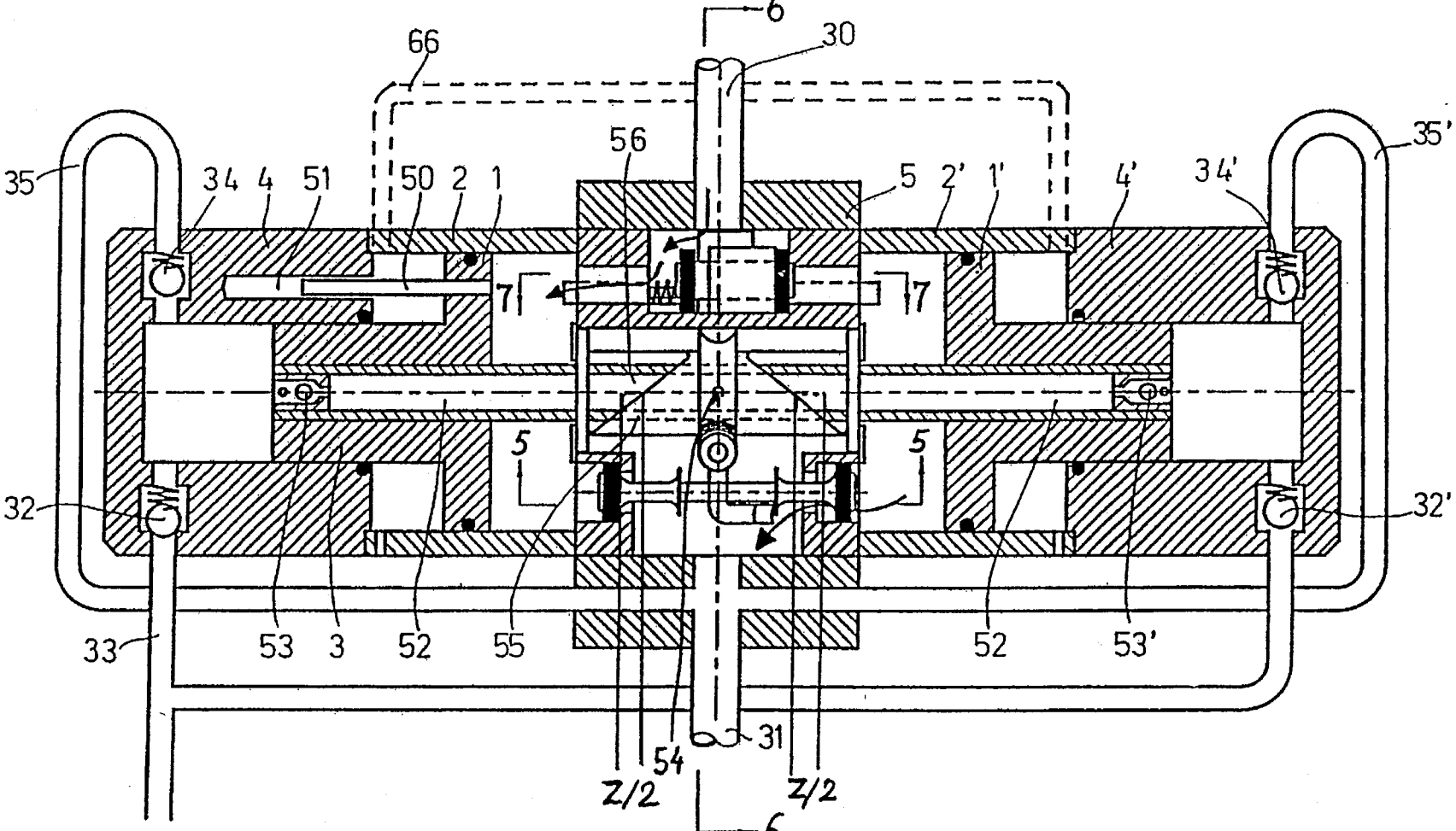
FIG. 2 shows a vertical diametrical section through a second embodiment of a dosing arrangement according to the invention.

As shown in the drawing FIGS. 1 and 2, the dosing arrangement comprises a liquid motor driven by the second liquid medium B, which e.g. could be hot or cold water under pressure, and two dosing pumps for a first liquid medium A, which could be a chemical, e.g. a cleaning agent or a disinfectant, which is to be dosed into liquid B.

The liquid motor consists of a piston rod 12 common for two mutually connected motor pistons 1 and 1' each moving in its own motor cylinder, respectively 2 and 2'.

Outside, in continuation of, and coaxially with, each of the cylinders 2 and 2', there is a dosing pump consisting of a pump piston 3, 3' respectively, moving each in its own pump cylinder 4, 4' respectively.

The pistons 1 and 3 and 1' and 3' are mutually permanently connected. They may, for example, be produced in one piece from the same stock material. The piston in a dosing pump, therefore, has the same length of stroke as the corresponding piston in the liquid motor.

The cylinders 2 and 2' are located on opposing sides of, and mounted, on a central body 5, which has a delivery pipe 30 for liquid B and a discharge pipe 31.

The cylinders 4 and 4' incorporate non-return valves 32 and 32', which control the intake of liquid A from a pipe 33, and non-return valves 34 and 34', which control the discharge of first liquid A from the cylinders into the pipes, respectively 35 and 35', which are connected to the discharge pipe 31 and the central body 5.

The central body 5 incorporates inlet valves 6 and 6' for delivery of the second liquid B to the cylinders 2 and 2' through motor inlet openings, respectively *6a* and *6a'*, and motor outlet valves 7 and 7' for discharge of liquid B from the cylinders 2 and 2' through discharge openings, respectively 11 and 11'. The valves 6 and 6' and 7 and 7' are embodied as seat valves. The valves 6 and 6' are mutually connected by an inlet valve rod 8, and the valves 7 and 7' are mutually connected by an outlet valve rod 10. The valves are moved in a direction parallel with the direction of travel of the pistons 1 and 1'. The special control of the valves prevents dirt or calcium from fouling the valve operation.

Figure 7:
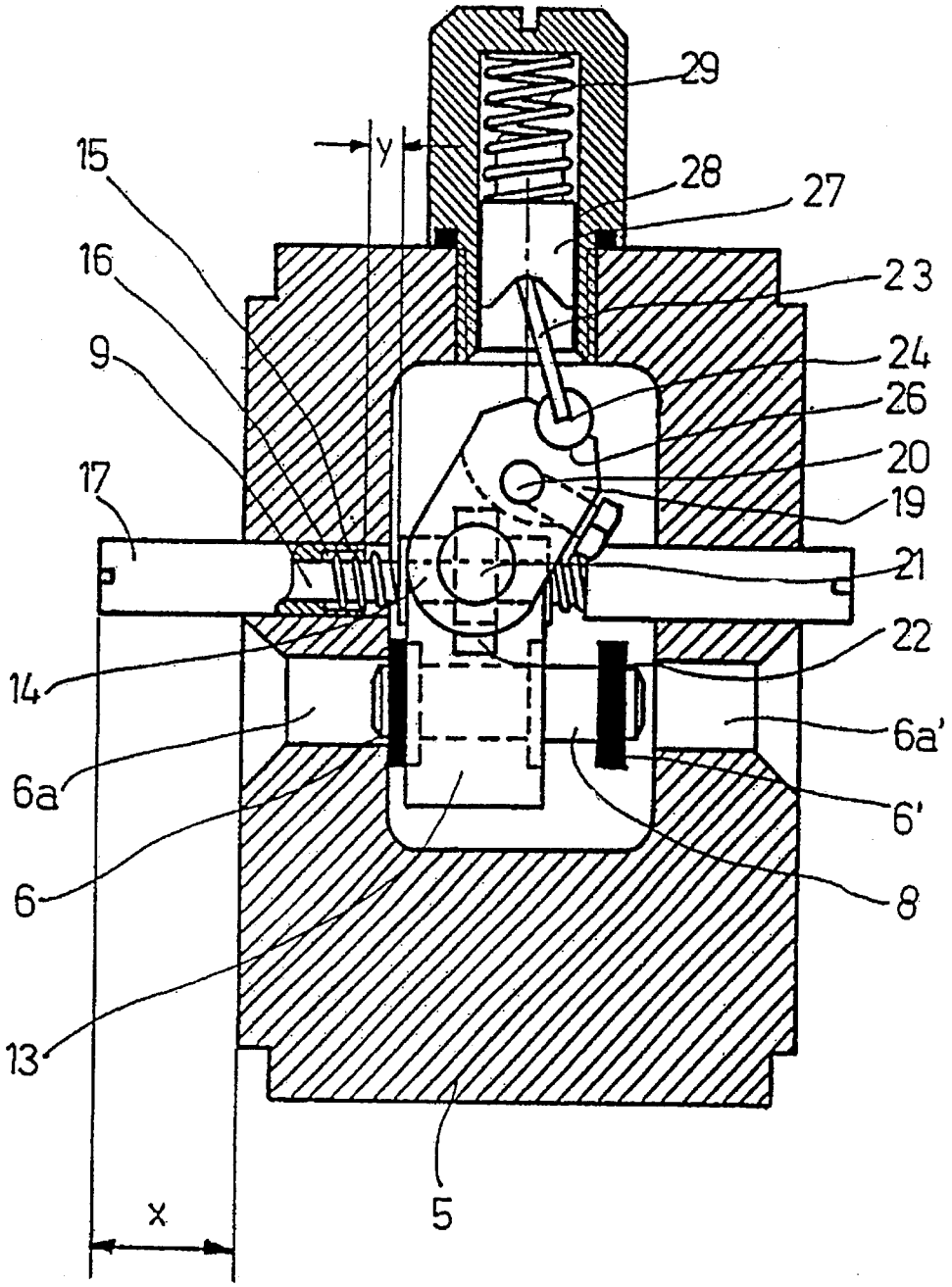
FIG. 7 shows a section after the line 7—7 in FIG. 2.

In the central body 5 is embedded a push rod 9, which can be displaced in a direction parallel with the direction of travel of the piston 1 and 1'. The push rod is placed in such a way, and with such a length, that when one of the valves 6 or 6' is closed, it protrudes a short distance X into the belonging cylinder, respectively 2 or 2'. The push rod 9 is carried right through the central body 5 and through a bearing 14 in a sliding block 13 displaceably positioned on a surface in the central body. As shown in FIG. 7 the connection rod 8 between the valves 6 and 6' is displaceably embedded in the sliding block 13. The sliding block has a width which is less than the inside distance between the valves 6, 6'. At each end, the push rod 9 can be embodied with a sleeve 17, which for example could be screwed to the rod. At the end facing the sliding block 13, each sleeve 17 is embodied with a recess 16 which takes up a spring 15, which is slid over the rod 9. The recess 16 is of such a length that the spring 15 can be taken up in the recess 16 in the compressed state. The sleeves 17 are of such a length that when the rod 9 is in the neutral position where the springs 15 are not compressed, they end a short distance Y from the side surfaces of the sliding block 13.

One end of the sliding block 13 has its central portion embodied with slit 22 meshing with a pin 21 mounted on a counterweight 19. The counterweight 19 is rigidly mounted on a pivot 20 located outside the sliding block in a center line in the central body 5 and is pivotally embedded in the central body. At one end of the counterweight 19 opposite the pin 21, the counterweight 19 is in mesh with a pressure arm 23, which has a cylindrical pressure shoe 24, which is taken up in a track 26, which is shaped as a part of a cylinder in the end of the counterweight 19. At the opposite end of the pressure arm 23, of the pressure arm 23, the pressure arm 23 is swingably hinged to a pressure arm piston 27, which can travel in a pressure arm cylinder 28 and whose upper side is acted on by a spring 29.

The pivot 20 is taken down through the central body 5 to a level a little above or a little below the connection rod 10 between the outlet valves 7 and 7' and which at the lower end has a bent part 20'. The rod 10 is embodied with two collars 37, 37'. These collars are located—and the folded part 20' has a length—so that the end of the part 20' can come to rest against one of the collars 37, 37' and bring the motor outlet valve 7 or 7' to an open position, when the motor inlet valve 6 or 6' is in the closed position.

If, for example, the valve 6' is in the open position, liquid will flow into the cylinder 2', whereby the pistons 1 and 1' are moved to the right. When the piston 1 nears the bottom position, it will hit the end of the rod 9 which will thereby be displaced to the right. This will compress first, the spring 15, whereafter the end of a sleeve 17 comes to rest against the side of the sliding block 13 and displaces it towards the right. The sliding block 13 will bedisplaced by the push rod 9 and move freely along the rod 8, until it is displaced a distance which is a little longer than half the travel of the block 13 from one extreme position towards the other. Hereafter the sliding block 13 will be influenced by the spring action of the springs 15 and 29 and will continue its travel in which it will first hit the back of the valve 6' and then displace the valve body 6, 6', until the valve 6' is in its closed position and the belonging outlet valve 7' is opened, while the valves 6 and 7 belonging to the cylinder 2 are in their open and closed position, respectively. Liquid now flows into the cylinder 2, and the pistons 1 and 1' are forced to the left until piston 1' hits the rod 9 and the valves change over once again.

The way the dosing arrangement is described until now, it can be constructed to give an arbitrary, but regular dosing of a liquid medium A into another liquid medium B.

To make possible a variable dosing of a liquid A into a liquid B, the central body 5 incorporates an opening/closing arrangement, which over an adjustable length Z of the length S of the piston stroke, admits some of liquid B, which has passed the liquid motor, to the dosing cylinder, which draws liquid A from the pipe 33. There will be drawn liquid A only for a length of stroke of K=S−Z. The dosing proportion will thus be $D=A_6(S-Z)/A_1+A_6)$, in which $A_6$=area of the dosing piston, and $A_1$=area of the piston in the liquid motor.

Thus, D can assume all values between 0 and $A_6/A_1+A_6$.

Figure 8:
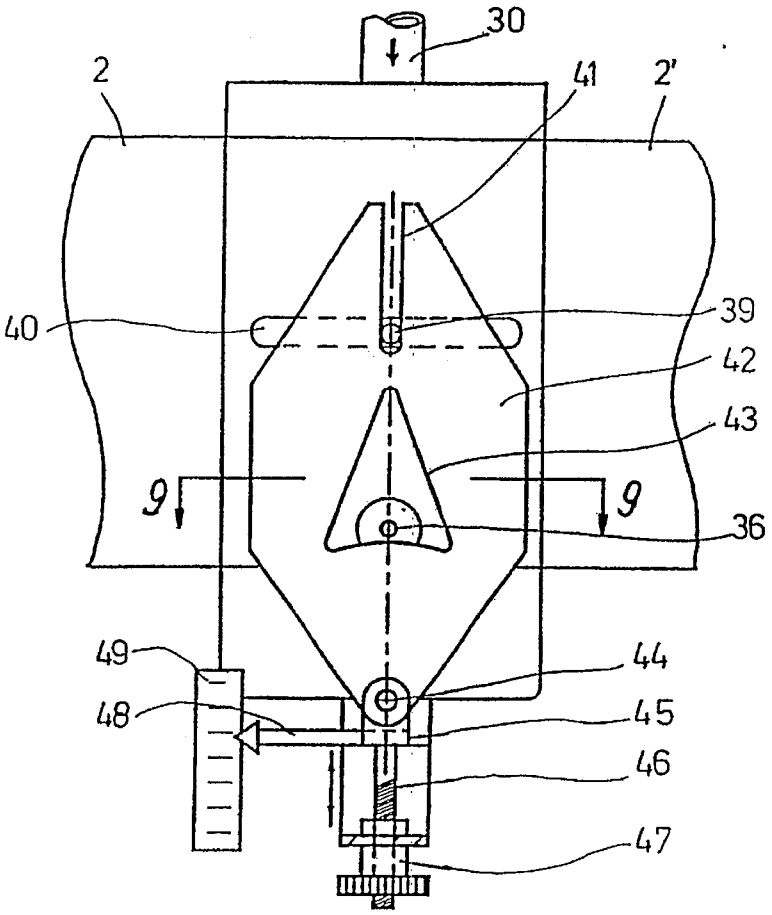
FIG. 8 shows a section after the line 8—8 in FIG. 4.
Figure 9:
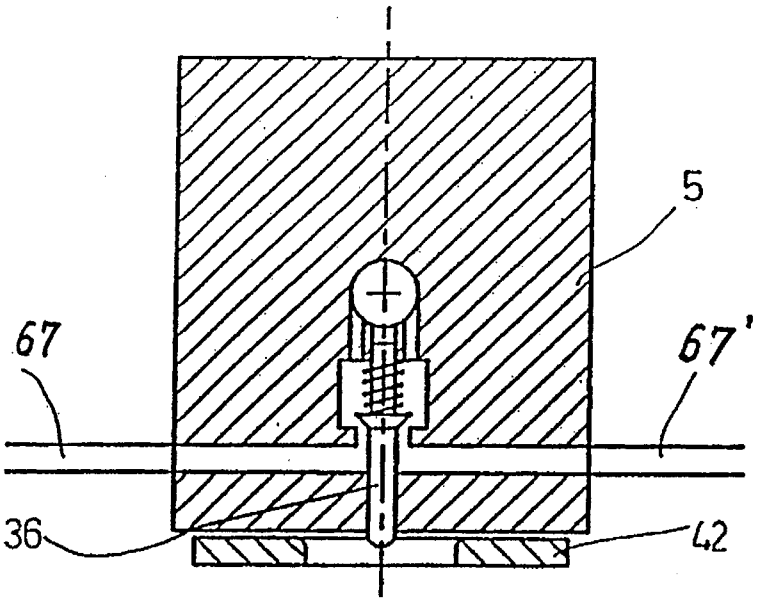
FIG. 9 shows a section after the line 9—9 in FIG. 8.

The system which supplies liquid B to the dosing cylinders 4 and 4' is in principle shown in FIGS. 1, 4, 8 and 9 and includes a valve 36, which is connected to the discharge pipe 31 for liquid B. When the valve 36 is opened, the liquid B can flow out into pipes 67 and 67' and taken through non-return valves 38 and 38' into the dosing cylinders 4 and 4'. These non-return valves have the effect that only liquid B will be let into the cylinder which sucks liquid A, and they prevent the opposite dosing pump from forcing liquid into the pipes 67 and 67'. In order to make the valve 36 open for a variable length of the length of stroke of the pistons, the piston rod can, for instance, by its movement control an opening/closing arrangement for the valve 36. This can, in principle, be an arm or second pin 39 mounted on the piston rod 12 and it can slide in a track 40 in the central body 5. The arm 39 also passes through a slit 41 in a curved disc plate 42, which has a specially shaped recess 43. The recess 43 is substantially an isosceles triangle which is symmetrical about a center line from the apex to the base. The curved disc can turn on a first pin 44 in a fork 45 which carries a spindle 46, which by means of a set screw 47, can be displaced in the vertical direction. When the arm 39 moves from side to side, the plate 42 will turn on the first pin 44, and during its sideways movement it will hit the valve in the discharge pipe 36, which is forced forward by a spring. When the plate slides over the pin, the latter is forced inward, and the valve 36 opens. The point at which the valve 36 opens during the movement of the piston rod 12 depends on the vertical position of the curved disc and of the shape of the special recess. The recess can be shaped so that there will be a linear relation between the vertical displacement of the curved disc 42 and the dosing. If the recess 43 is shaped as shown in FIG. 8, it will be seen that when the curved disc 42 is at its lowest position, the valve 36 will remain open, and when the curved disc is in its top position, the valve 36 will remain closed. Between these extremes, the recess will give a relation between the vertical position of the plate 42 and the part of the travel of the piston rod 12 in which the valve 36 is open. The spindle 46 has a pointer 48 pointing on a scale 49. The reading indicates a supply of liquid B to the dosing cylinder, which is under suction pressure, and consequently is a definite dosing. The reading is determined by the curved disc 42. Depending on the shape of the recess, the scale can be made linear or nonlinear for the desired dosing.

Figure 6:
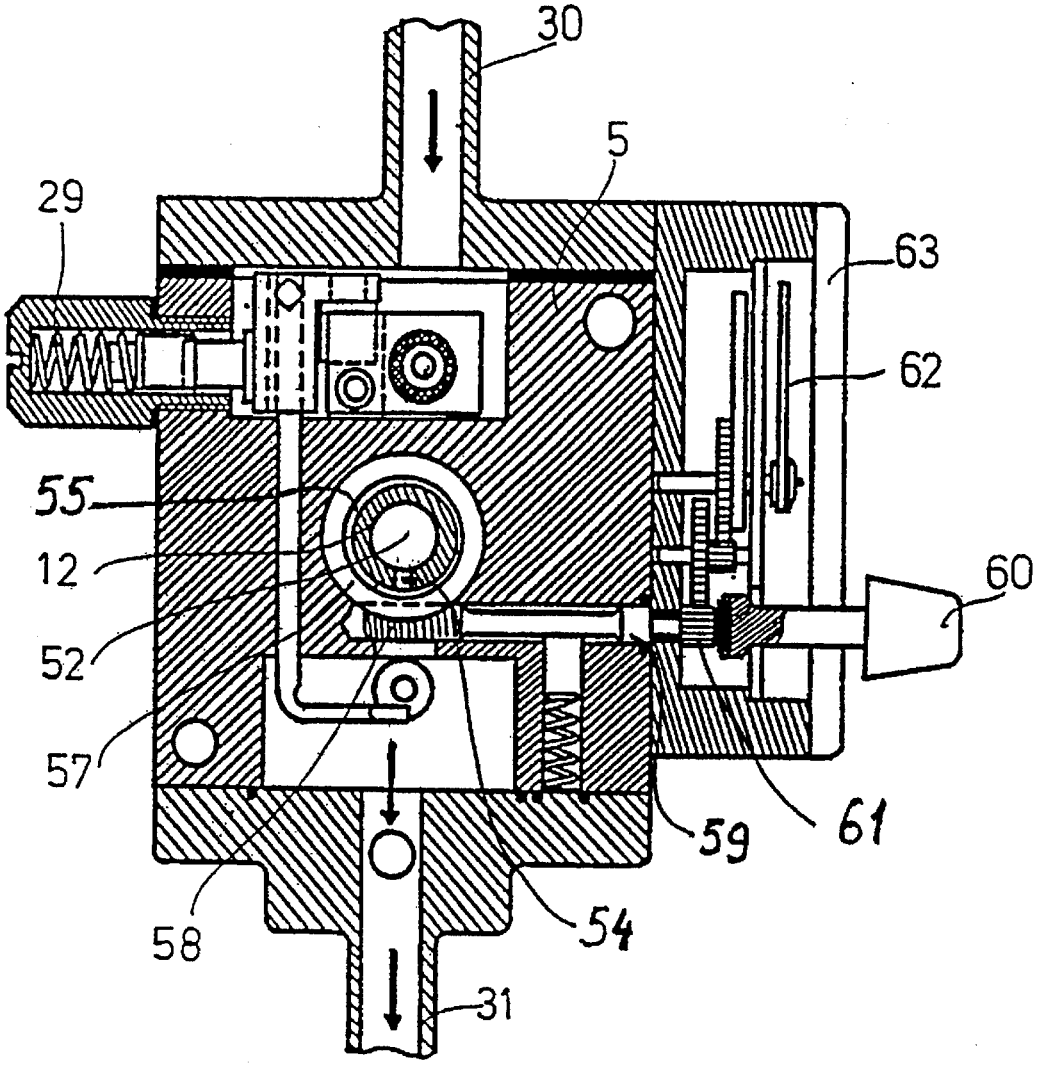
FIG. 6 shows a section after the line 6—6 in FIG. 2.

FIGS. 2 and 6 show an alternative system for the regulation of the dose by inlet of a desired and variable volume of liquid B from the central body 5 to the cylinder 4 or 4', which is under suction pressure.

As shown in the drawing, the piston rod 12 is carried through the pistons 1, 3 and 1', 3', and the piston rod 12 is embodied as a pipe with an internal hollow space 52, which is in connection with the cylinders 4, 4' through non-return valves 53 and 53', which are mounted one at each end of the piston rod 12. The piston rod 12 carries a sleeve 55 with a journal fit in the central body 5. The sleeve has a length, which equals approximately the width of the central body 5. The bushing is mounted in such a manner in the central body that it is held in place against sideways displacement in the longitudinal direction of the piston rod 12. However, it can turn in relation to the piston rod, which is prevented from rotating as a guide pin 50 mounted on the piston moves in a bored hole 51 in the cylinder 4.

The bushing 55 is embodied with one or more recesses 56. During the reciprocating movements of the piston rod 12, when a hole 54 in the piston rod 12 is positioned in a recess 56, there is passage for liquid B from the central body 5 to the hollow space 52 in the piston rod 12 and from there through one of the non-return valves 53 or 53' to the cylinder 4 or 4', which is under suction pressure. When the hole 54 is just outside a recess 56, the flow of liquid is barred from the central body through the hole 54.

The recesses 56 are shaped so that the length Z of the piston rod's travel where a discharge of liquid is taking place, can be altered by turning the bushing 55. The recesses can, as shown, have a shape as two identical right-angled isosceles triangles positioned at each end of the bushing, and where one side is parallel with the axis of the bushing 55 and the other is located in a plane close to the end of the bushing and at right angles to the axis of the bushing 55. The third side of the triangle will thus be oblique in relation to the longitudinal axis of the bushing, and a linear relation can be obtained between the dosing percentage and the turning angle of the bushing 55.

In the way the bushing 55 is embodied with recesses in both ends, liquid medium B will be delivered to the dosing cylinder 4 or 4', which sucks liquid A at the beginning and end of the suction stroke. This is especially desirable as piston or diaphragm pumps can have problems sucking the first liquid up into the cylinder if there is only air in the cylinder at the start-up. If no liquid is sucked in during start-up at the last part of the suction stroke, the liquid flowing through the hole 54 to the cylinder will fill the latter with liquid. This will instantaneously solve the starting troubles of the dosing pump. Another advantage of the system is that at the end of a liquid dosing, it is easy to clean the dosing cylinders by cutting off the liquid supply to the pipe 33 and letting the liquid motor run for some time whereby the liquid, e.g. water, flows through the non-return valves 53, 53' into the dosing pumps and clean them.

In order to control the variable input of liquid through the hole 54 and obtain the desired dosing, the bushing 55 can be turned on the piston rod 12 by means of a worm 58 meshing with a worm gear 57 mounted on the center of the bushing. By turning the bushing 55 and its recess 56 in relation to the hole 54, the lengths Z of the length S of the piston strokes, where the hole 54 is in a recess, will be seen to be infinitely variable from the value Z=0 to Z=S, depending on the shape of the recesses. The worm 58 can be turned manually with an attached knob 60, and its rotations can, through a gear arrangement, make a pointer 62 point on a scale 63 showing the dosing percentage of liquid A in relation to the volume of liquid B which suits the liquid motor. The worm 58 can also be electrically remote-controlled. The shaping of the recesses 56 can give a linear or nonlinear relationship between the rotations of the worm 58 and the scale reading.

Figure 3:
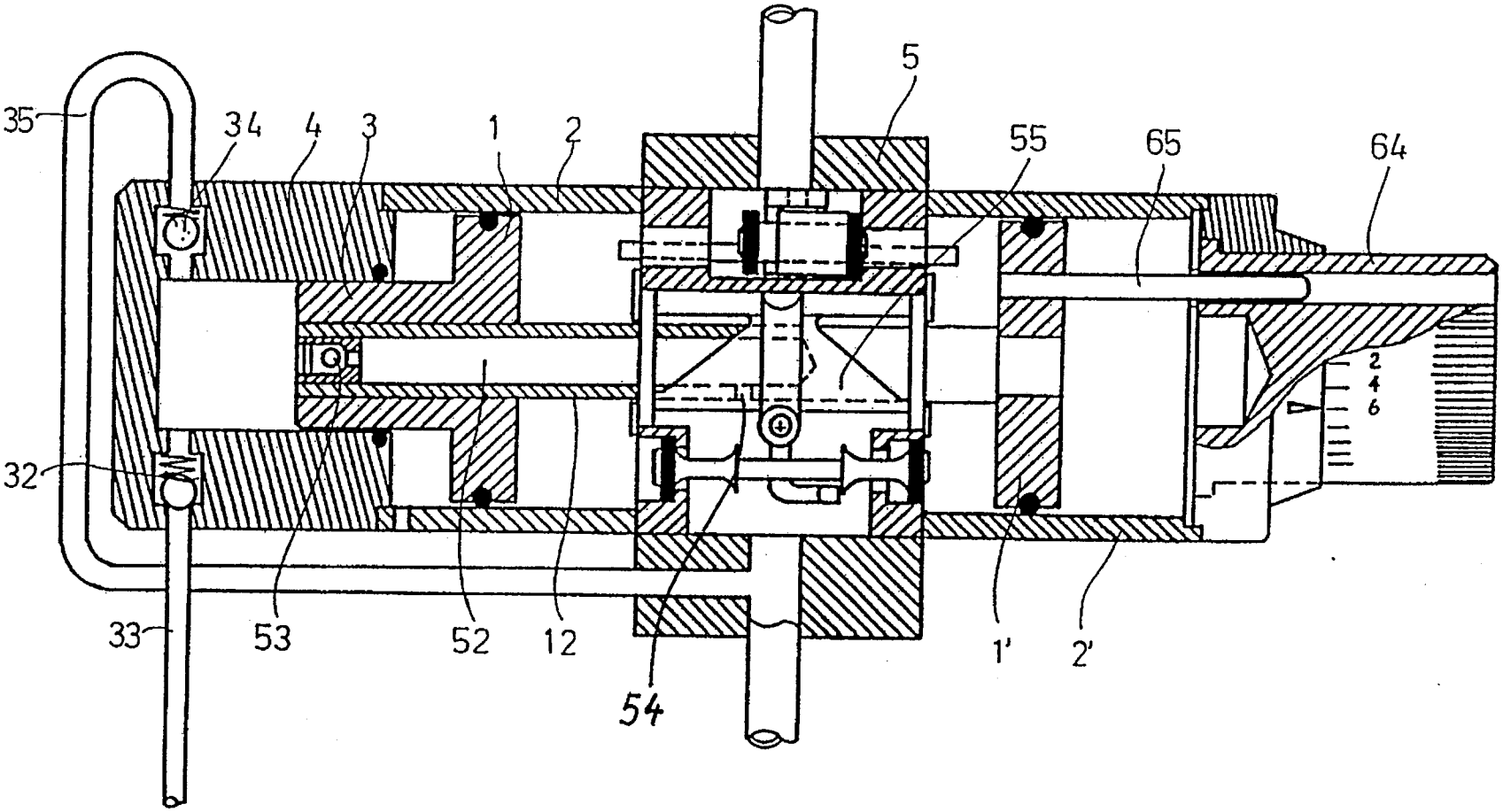
FIG. 3 shows a partial section through a third embodiment of a dosing arrangement according to the invention.
Figure 4:
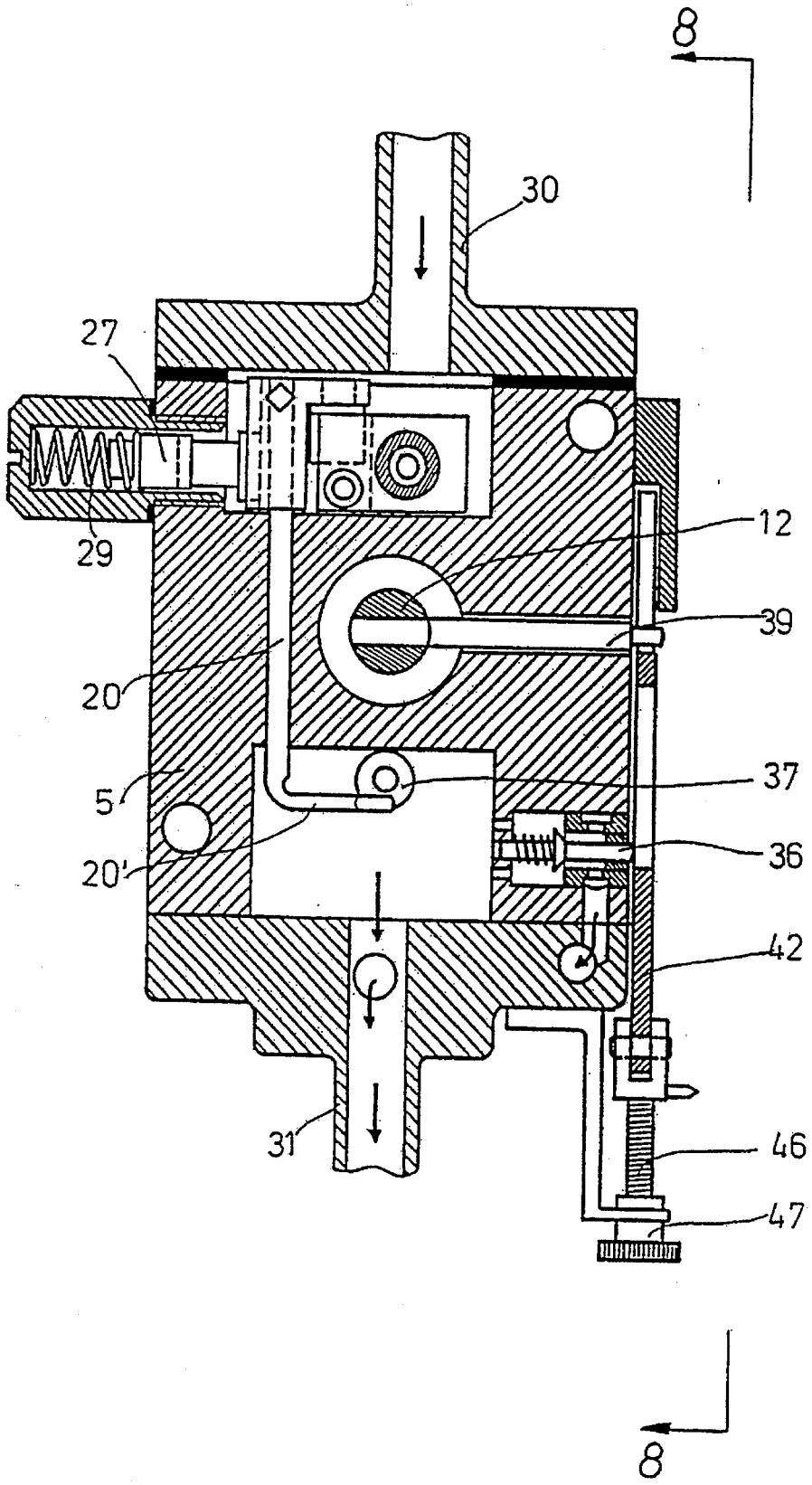
FIG. 4 shows a section after the line 4—4 in FIG. 1.
Figure 5:
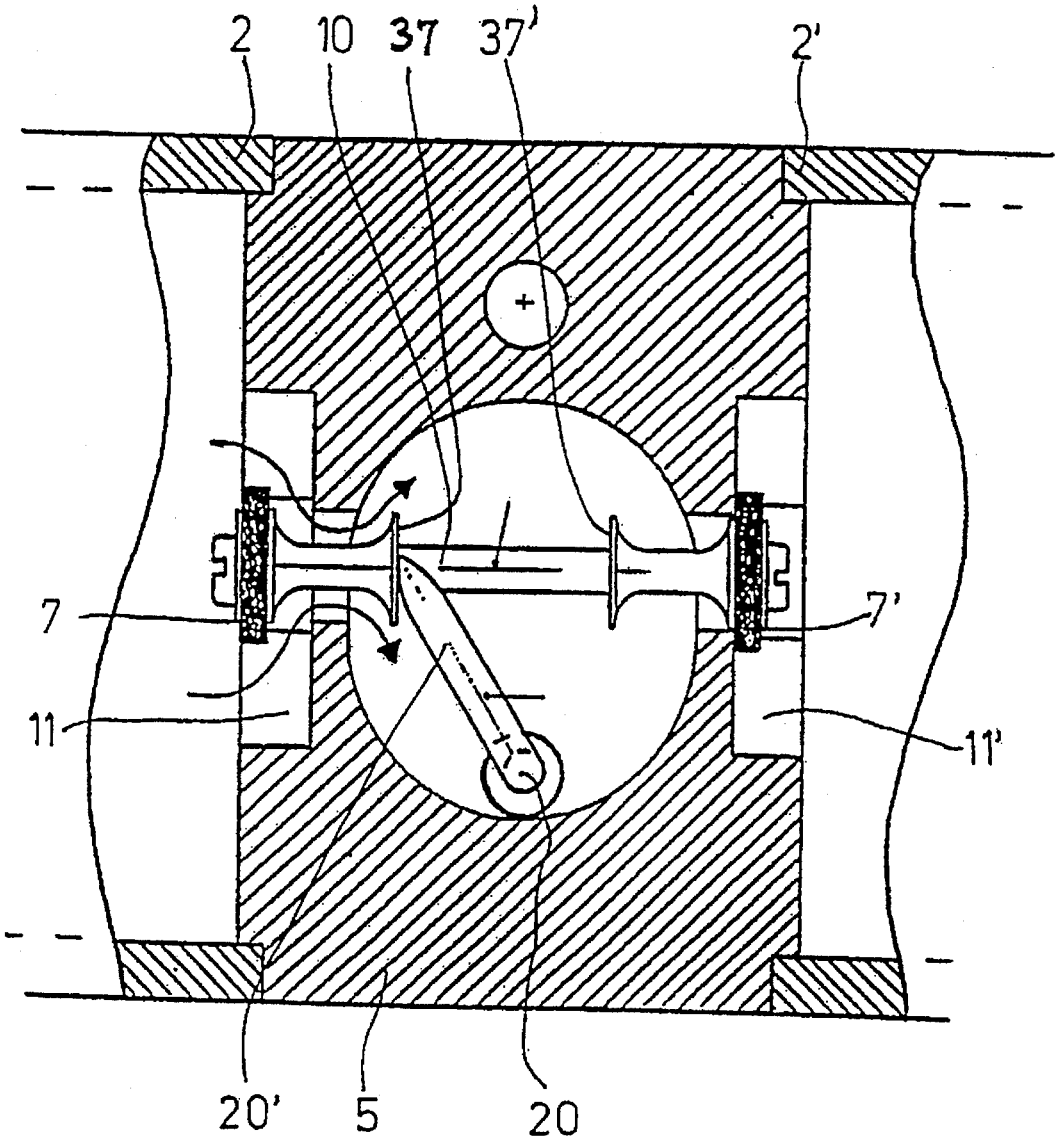
FIG. 5 shows a section after the line 5—5 in FIG. 2.

As shown in FIG. 3 the bushing 55 can also be immovably mounted, and the dosing can be varied by turning the piston rod 12 by turning a knob 64, which through a dog pin 65 is meshing with the piston 1'. This embodiment comprises only one dosing pump having pump piston 3 and pump cylinder 4.

As shown in FIGS. 1 and 2 it is also possible to mount pipes 66 causing a doubling of the volume of the liquid flow. The packings in the pistons are kept tight, even in the case of high pressures.

Instead of pistons, it is of course, also possible to use diaphragms.

I claim:

1. Dosing arrangement for the dosing of at least a first liquid medium A into a second liquid medium B and which comprises a piston type liquid motor which is driven by the second liquid medium B and consists of two mutually connected motor pistons (1, 1') on a common piston rod (12) each motor piston traveling in its own motor cylinder (2, 2'), and having a length of stroke, motor inlet valves (6, 6') and motor outlet valves (7, 7') for delivery and discharge of the second liquid B to and from the motor cylinders (2, 2') and at least one dosing pump, for the first liquid A, the at least one dosing pump being embodied as a piston pump consisting of two pump pistons (3, 3') traveling each in its own pump cylinder (4, 4'), which are positioned outward from, in continuation of and coaxially with the motor cylinders (2, 2') and which are mechanically connected to the motor pistons (1, 1'), motor outlet valves for delivery and discharge of the first liquid medium A to and from the pump cylinders (4, 4'), pipe connections for supply of the first liquid medium A from the dosing pumps to a discharge pipe from the liquid motor, and means for regulation of the proportion of mix, the dosing arrangement comprising the motor pistons and the pump pistons (3, 1, 3', 1') being mutually permanently connected and attached to a central body (5), the one of the motor cylinders and one of the pump cylinders (2, 4, 2', and 4') being positioned on opposite sides of the central body from the other of the motor cylinders and the other of the pump cylinders, the central body having a width which is greater than the length of stroke of the motor piston (1, 1'), in which the motor inlet valves (6, 6') for delivery and the motor outlet valves (7, 7') for discharge of the second liquid B to and from the motor cylinders (2, 2') are built in, the motor inlet valves (6, 6') being embodied as seat valves, which are mutually connected by an inlet valve rod (8) being moved in a direction parallel with the direction of travel of the motor pistons (1, 1'), and which in their extreme positions close a delivery opening (*6a*, *6a'*) to the motor cylinders (2, 2'), respectively, the motor inlet valves (6, 6') by means of the inlet valve rod (8) being instantaneously changed from one extreme position to the other by means of a spring mechanism coupled to a push rod (9), said push rod (9) being displacably embedded in the central body (5) so that the push rod can move in a direction parallel with the inlet valve rod (8), being placed and having a length so that when one of the motor inlet valves (6, 6') is closed, the push rod protrudes a short distance (X) into the motor cylinder, respectively (2, 2') and is displaced by the motor piston, (1, 1') when the latter travels towards its bottom dead center towards the central body 5, the motor outlet valves (7, 7') being embodied as seat valves which are mutually connected by an outlet valve rod (10), which is parallel with the inlet valve rod (8) being moved in a direction which is parallel with the direction of movement of the motor inlet valves (6, 6') and in their extreme positions said motor inlet valves (6, 6') can close the discharge openings (11, 11') from the motor cylinders (2, 2'), respectively, and that the movement of the motor outlet valves (7, 7') are firmly coupled to the movement of the motor inlet valves (6, 6'), the central body (5) being hollow and filled with the second liquid medium B, the central body (5) incorporating an opening/closing arrangement which, in correspondence with the movement of a piston rod (12), delivers a desired and variable volume of the second liquid medium B from the central body (5) to the pump cylinder (4 4'), which is under suction pressure.

2. Dosing arrangement according to claim 1 further comprising the motor inlet valves (6, 6') being spaced apart and having an internal distance therebetween, the inlet valve rod (8) being displaceably mounted in a sliding block (13), which is displaceably positioned on a surface in the central body (5) and has a width which is smaller than the internal distance between the motor inlet valves (6, 6'), the sliding block (13) in its extreme positions can come to rest either against a collar on the inlet valve rod (8) or against the motor inlet valves (6, 6') and bring the said motor inlet valves to a closed position, the sliding block (13) further having a bearing (14), in which the push rod (9) is displaceably mounted, the push rod (9) on each side of the sliding block (13) Carrying a spring (15) one end of the spring against the sliding block (13), another end of the spring resting against the bottom of a (16) in a sleeve (17) which is slid in over and attached to each end of the push rod (9), the sleeve having an end, the end being disposed a short distance (Y) from a side surface of the sliding block (13), and the recesses (16) having such a length that the spring (15), in its compressed position, can be taken up in the recess (16), whereby the end of the sleeve (17) can come to rest against the side surface of the sliding block (13), the sliding block being in mesh with a counterweight (19), the counterweight (19) being permanently mounted on a pivot (20) located in a center line in the central body (5) a pin (21) being mounted on a first end of the counterweight, the pin meshing with a slit (22) in the sliding block (13), the counterweight (19) having a second opposite end, the second end meshing with a pressure arm (23), the pressure arm having a first end and an opposite second end, the first end being embodied with a cylindrical pressure shoe (24), the pressure shoe being taken up in a track (26) in the counterweight (19), the track (26) being shaped as part of a cylinder, the second end of the pressure arm being swingably hinged to a pressure arm piston (27), the pressure arm piston traveling in a pressure arm cylinder (28) having an upper surface, the upper surface being actuated by a compression spring (29).

3. Dosing arrangement according to claim 2 wherein the difference (X–Y) between the protrusion distance (X) and the distance (Y) is greater than half the travel of the block (13) from one extreme position to another.

4. Dosing arrangement according to claim 2 further comprising the pivot (20) being carried down through the central body (5) to a level above or below the outlet valve rod (10) between the outlet valves (7, 7'), the pivot (20) having a lower end, the lower end having a bent part (20'), the lower end resting against two collars (37) on the outlet valve rod (10), the bent part (20') having a length and the collars (37) being so positioned, that when one of the motor inlet valves (6, 6') is in its closed position, the corresponding motor outlet valve (7, 7') is open.

5. Dosing arrangement according to claim 1 wherein the opening/closing arrangement for the supply of the second liquid medium B from the central body (5) to the pump cylinder (4, 4'), which is under suction pressure, comprises two pipes (67, 67'), with built-in non-return valves, (38, 38'), the pipes being connected to a valve (36) in the discharge pipe (31) for second liquid medium B from the central body (5), the valve (36) having a valve spindle embodied as a spring-loaded pin, the pin being activated by a plate (42) having one or more recesses (43), the plate having a bottom swingably hinged to a first pin (44) in a fork (45), the plate (42) having a top, a vertical slit (42) formed in the top of the plate vertically above the first pin (44), the slit (41) meshing with a second pin (39) mounted on the piston rod (12), preferably centrally between the pistons (1, 1') so that the plate (42) is set in swinging motion round the first pin (44) by the piston rod (12) whereby the valve (36) which is located vertically over the first pin (44), is closed when it takes up a position in the recess (43) and is open when it is a position outside the recess, the piston rod (12) having a length (2) of travel, the recess or recesses (43) being shaped so that the length (Z) of the travel of the piston rod (12) during which there will be a delivery of second liquid medium B to the cylinder which is under suction pressure, can be varied by displacement of the plate (42) in relation to the valve (36), the plate (42) being displaceable in the vertical direction, by means of a screw spindle (46) with a set screw (47) whereby the location of the recess (43) in relation to the valve (36) can be varied, and the vertical position of the plate (42) being read on a scale (49) by a pointer (48) mounted on the fork (45).

6. Dosing arrangement according to claim 5, further comprising the recess (43) being shaped as an isosceles triangle having a base, an apex and a height therebetween, the triangle being located so that a connecting line between the second pin (39) and the first pin (44) is a symmetry line in the triangle, the vertical slit having a length and a bottom, the height of the triangle being approximately equal to the length of the vertical slit (41), wherein when the valve (36) is in one extreme position of the plate (42), the pin (39) is in the bottom of the vertical slit (41), having a position either close to the base of the triangle or close to the apex of the triangle, the scale (49) having a calibration indicating the dosing.

7. Dosing arrangement according to claim 1, wherein the piston rod (12) is carried through the motor pistons and the pump pistons (1, 3, 1', 3') the piston rod being embodied as a pipe with a hollow space (52) inside the piston rod (12) the piston rod having a length of travel (Z), a first end, an opposite second end, one non-return valve mounted at each end of the piston rod, the non-return valves opening a pair of non-return valves (53, 53') when the pressure in the hollow space (52) is greater than atmospheric, the piston rod (12) disposed between the motor pistons (1, 1') has a hole (54) through which second liquid medium B can pass from the central body (5) to the hollow space (52), the piston rod (12) having an outside surface in the central body (5), a bushing (55) with a slide pass being mounted on the outside surface of the piston rod, the bushing (55) having two opposite ends, a middle therebetween, a longitudinal axis and a length which is approximately equal to the width of the central body (5) the bushing being embedded in the central body (5), the bushing (55) having one or more recesses (56), second liquid medium B flowing from the central body into the hollow space (52) through the one or more recesses (56) when the hole (54) is disposed in the respective recess (56) during movement of the pump piston rod (12), the second liquid medium B being prevented from flowing when the hole (54) is disposed outside the recess, the recesses (56) being shaped that the length (Z) of the travel of the piston rod (12) over which a flow of liquid takes place, can be varied by turning the bushing (55).

8. Dosing arrangement according to claim 7, wherein the means for holding the piston rod (12) in an unchanged position of rotation is provided by a guide pin (50) mounted on the motor piston (1) and sliding in a bored hole (51) in the pump cylinder (4).

9. Dosing arrangement according to claim 8 further comprising the bushing (55) having two identical recesses (56) each disposed at a respective end of the bushing (55), each recess being shaped as an isosceles triangle having two sides forming a right angle, one side of the isosceles triangle being parallel with the longitudinal axis of the bushing (55) the other side being located close to the end of the bushing (55) in a plane at right angles to the longitudinal axis of the bushing (55) the other side extending to approximately the middle of the bushing (55), a worm gear (57) mounted at the middle of the bushing, the worm gear meshing with a worm (58) having a shaft (59), the shaft (59) being connected to a turning knob (60), the shaft (59) carrying a gear wheel (61) having a toothed gearing, the tooth gearing being connected to a pointer (62), so that the position of the bushing (55) and thereby the volume of the dosing can be read on a scale (63).

* * * * *